US009960533B2

(12) United States Patent
Kudo

(10) Patent No.: US 9,960,533 B2
(45) Date of Patent: May 1, 2018

(54) CONNECTOR WITH LOCKING MECHANISM

(71) Applicant: J.S.T. Mfg. Co., Ltd., Osaka-shi (JP)

(72) Inventor: Hironori Kudo, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days. days.

(21) Appl. No.: 15/465,884

(22) Filed: Mar. 22, 2017

(65) Prior Publication Data

US 2017/0279220 A1 Sep. 28, 2017

(30) Foreign Application Priority Data

Mar. 25, 2016 (JP) ..... 2016-061130

(51) Int. Cl.
*H01R 13/627* (2006.01)
*H01R 4/02* (2006.01)

(52) U.S. Cl.
CPC ..... *H01R 13/6272* (2013.01); *H01R 4/023* (2013.01)

(58) Field of Classification Search
CPC ..... H01R 13/6272; H01R 4/023
USPC ..... 439/357
See application file for complete search history.

(56) References Cited

U.S. PATENT DOCUMENTS 5,114,355 A * 5/1992 Kimmel ..... H01R 23/6873 439/101
5,131,872 A * 7/1992 Consoli ..... H01R 12/716 439/751
5,199,909 A * 4/1993 Molitor ..... H01R 13/113 439/651
5,378,175 A * 1/1995 Regnier ..... H01R 12/716 439/733.1
5,516,303 A * 5/1996 Yohn ..... H01R 13/6315 439/248
5,695,354 A * 12/1997 Noda ..... H01R 12/716 439/326
7,198,525 B2 * 4/2007 Nagamine ..... H01R 12/721 439/843
7,438,599 B2 * 10/2008 Uchida ..... G06K 7/0021 439/630
8,221,139 B2 * 7/2012 Qin ..... H01R 13/6471 439/92

(Continued)

FOREIGN PATENT DOCUMENTS

JP 2000-067988 A 3/2000
JP 2000-164294 A 6/2000

*Primary Examiner* — Alexander Gilman
(74) *Attorney, Agent, or Firm* — Kratz, Quintos & Hanson, LLP

(57) ABSTRACT

The connector is provided with a locking mechanism capable of engaging and disengaging with each other a receptacle and a plug. The receptacle is provided with a first housing and a first contact. The plug is provided with a second housing and a second contact. The first housing has at a recess portion a lock arm provided at its end with a hook portion. The second housing has at a header portion an engaging protrusion. When the header portion is inserted into the recess portion, the engaging protrusion rides over the hook portion, and the complete fitting of the receptacle and the plug can be felt. When the header portion is pulled out from the recess portion, the hook portion is displaced, and the plug can be readily pulled out from the receptacle.

6 Claims, 7 Drawing Sheets

(56) References Cited

U.S. PATENT DOCUMENTS

| | | | | |
|---|---|---|---|---|
| 8,801,471 | B2 * | 8/2014 | Zhu | H01R 13/6271 439/357 |
| 2006/0154512 | A1 * | 7/2006 | Shimizu | H01R 43/01 439/387 |
| 2010/0323564 | A1 * | 12/2010 | Clark | H01R 13/2457 439/862 |
| 2013/0323988 | A1 * | 12/2013 | Matoba | H01R 4/48 439/855 |

* cited by examiner

CONNECTOR WITH LOCKING MECHANISM

This application is based on and claims the benefit of priority from Japanese Patent Application No. 2016-061130, filed on 25 Mar. 2016, the content of which is incorporated herein by reference.

BACKGROUND OF THE INVENTION

Field of the Invention

The present invention relates to a connector with a locking mechanism. In particular, the present invention relates to a connector with a locking mechanism, provided with a locking mechanism making it possible to mechanically retain a mating connector.

Related Art

Connectors made of an electrically and mechanically connected pair of a connector where a socket contact with a plurality of attached cables is mounted, and a connector having a plurality of pin contacts, are known. For example, circuit board-to-wire connectors are known. In this case, one connector is mounted on the printed circuit board, and another connector with an attached cable is detachably connected to the one connector.

Such connectors for electrical connection, in order to reliably connect the one connector with the other connector, are often provided with locking mechanisms. In circuit board-to-wire connectors, with respect to one connector, the cables are arranged on the other connector, and therefore, these are particularly frequently provided with locking mechanisms.

As such connectors with locking mechanisms, for example, the one disclosed in Japanese Unexamined Patent Application, First Publication No. 2000-164294 (below referred to as Patent Document 1) may be mentioned. Patent Document 1 discloses a connector with a locking mechanism provided with a so-called lever lock type locking mechanism wherein one connector on which a plurality of cables is disposed is provided with a lever type lock arm, and another connector is provided with a hook portion lockable with the lock arm.

Further, as such connectors with locking mechanisms, for example, the one disclosed in Japanese Unexamined Patent Application, First Publication No. 2000-67988 (below referred to as Patent Document 2) may be mentioned. Patent Document 2 discloses a connector with a locking mechanism provided with a so-called friction lock type locking mechanism wherein one connector on which a plurality of cables is disposed is provided with a pair of protrusions projecting from an outer wall, and on the other connector a pair of locking holes which fit these protrusions are opened so as to pass through from an inner wall to an outer wall, and the one connector and the other connector are locked by frictional force.

In the lever lock type locking mechanism disclosed in Patent Document 1, the complete fitting of the plug and the base connector can be felt by the feeling when the tip of the lock arm rides over the engaging protrusion (the so-called click feel).

On the other hand, in the lever lock type locking mechanism, other than when inserting and removing the connectors, the lock arm constituted at the outer wall of the housing can be said to be an unnecessary protrusion. There is the concern that other objects mounted on the printed circuit board may abut the lock arm, thereby making the locking of the connectors unstable.

The friction lock type locking mechanism disclosed in Patent Document 2 is not provided with a lock arm provided at the outer wall of the connector, and thus there is no concern of the locking of the connectors becoming unstable.

However, the friction lock type locking mechanism locks the one connector and the other connector by frictional force, and therefore, it is an inconvenient structure in that it is not easy to feel the complete fitting of the one connector and the other connector.

The present invention was made in consideration of problems such as those described above, and has the objective of providing a connector with a locking mechanism which, in addition to making it possible to feel the complete fitting of the one connector and the other connector, also has excellent operability.

SUMMARY OF THE INVENTION

The present inventor considered that, in a first connector, a lock arm is provided at an inner wall side of a first housing, projecting towards an open face of a recess portion formed in the first housing; in another second connector, a quadrangular frustum-shaped engaging protrusion is provided at a header portion of a second housing and is capable of engaging and disengaging with a hook portion formed at a tip of the lock arm; and when he header portion is inserted into the recess portion, the engaging protrusion rides over the hook portion and it is possible to feel the complete fitting of the first connector and the second connector; and when the header portion is pulled out from the recess portion, the hook portion is displaced, and the second connector can be easily pulled out from the first connector; and based on this, attained the invention of a novel connector with a locking mechanism described below.

The first aspect of the present invention is a connector with a locking mechanism provided with a locking mechanism capable of engaging and disengaging with each other one first connector and another second connector, wherein: the first connector is provided with a rectangular solid-shaped first housing having a recess portion where one face has an approximately rectangular-shaped opening, and one or more first contacts with a pin-shaped connecting terminal disposed at an inner portion of the recess portion; the second connector is provided with a rectangular solid-shaped second housing having at one end side a header portion which is fittable in the recess portion, and having at another end a flange portion which is partially abuttable with one face of the first housing, and a second contact disposed at an inner portion of the second housing and having at one end a bellows terminal which is connectable with the connecting terminal of the first contact; and wherein the first housing has a strip-shaped lock arm which is provided at a prescribed space from one inner wall of the recess portion and which projects from a bottom portion of the recess portion towards the open face of the recess portion approximately parallel to the one inner wall of the recess portion, the lock arm being provided at its tip with a trapezoidal-shaped hook portion which projects towards a central portion of the recess portion, and the second housing has one or more quadrangular frustum-shaped engaging protrusions which are capable of engaging and disengaging with the hook portion, protruding from one face of the header portion.

The second aspect of the invention is a connector with a locking mechanism according to the first aspect, wherein the first contact has a lead terminal which is continuous with the connecting terminal, and which can be solder-joined to the printed circuit board.

The third aspect of the present invention is a connector with a locking mechanism according to the first or second aspect, wherein the second contact has at another end a pressure welding terminal for hard-wiring by pressure welding an end of a cable.

The fourth aspect of the present invention is a connector with a locking mechanism according to the second aspect, wherein in the first contact, the lead terminal is bent at an approximately right angle with respect to the connecting terminal.

BRIEF DESCRIPTION OF THE DRAWINGS

FIG. 4A is a plan view of the connector with a locking mechanism and shows a state wherein the one first connector and the other second connector are connected; FIG. 4B is a front view of FIG. 4A; FIG. 4C is a back view of FIG. 4A; FIG. 4D is a right side view of FIG. 4A; 4E is a left side view of FIG. 4A; and FIG. 4F is a bottom view of FIG. 4A.

DETAILED DESCRIPTION OF THE INVENTION

Hereinafter, modes for carrying out the present invention will be described with reference to the drawings.

[Constitution of the Connector with a Locking Mechanism]

First, the constitution of the connector with a locking mechanism according to one embodiment of the present invention is explained.

Figure 1:
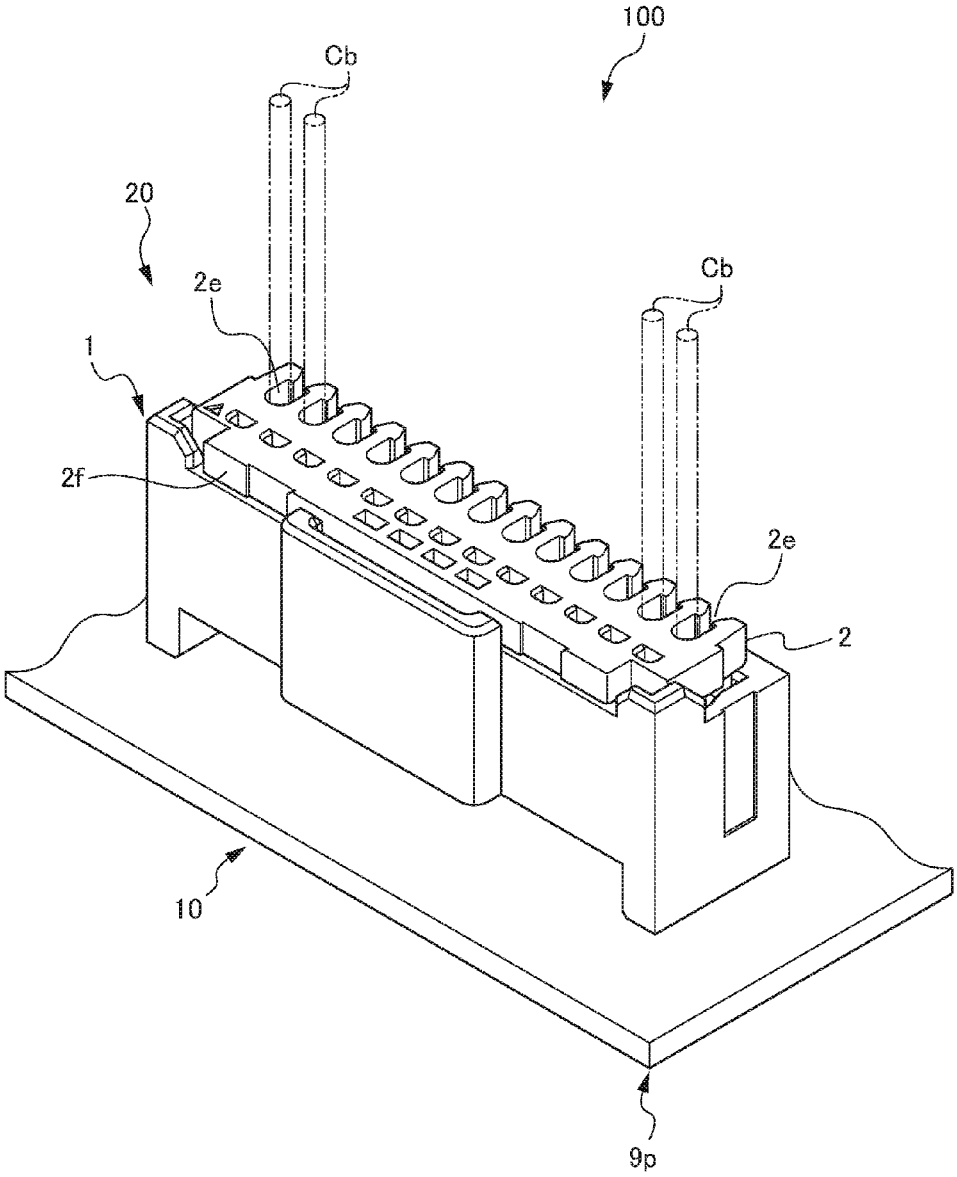
FIG. 1 is an oblique view showing the constitution of the connector with a locking mechanism according to one embodiment of the present invention, and shows a state wherein the one first connector and the other second connector are connected.
Figure 2:
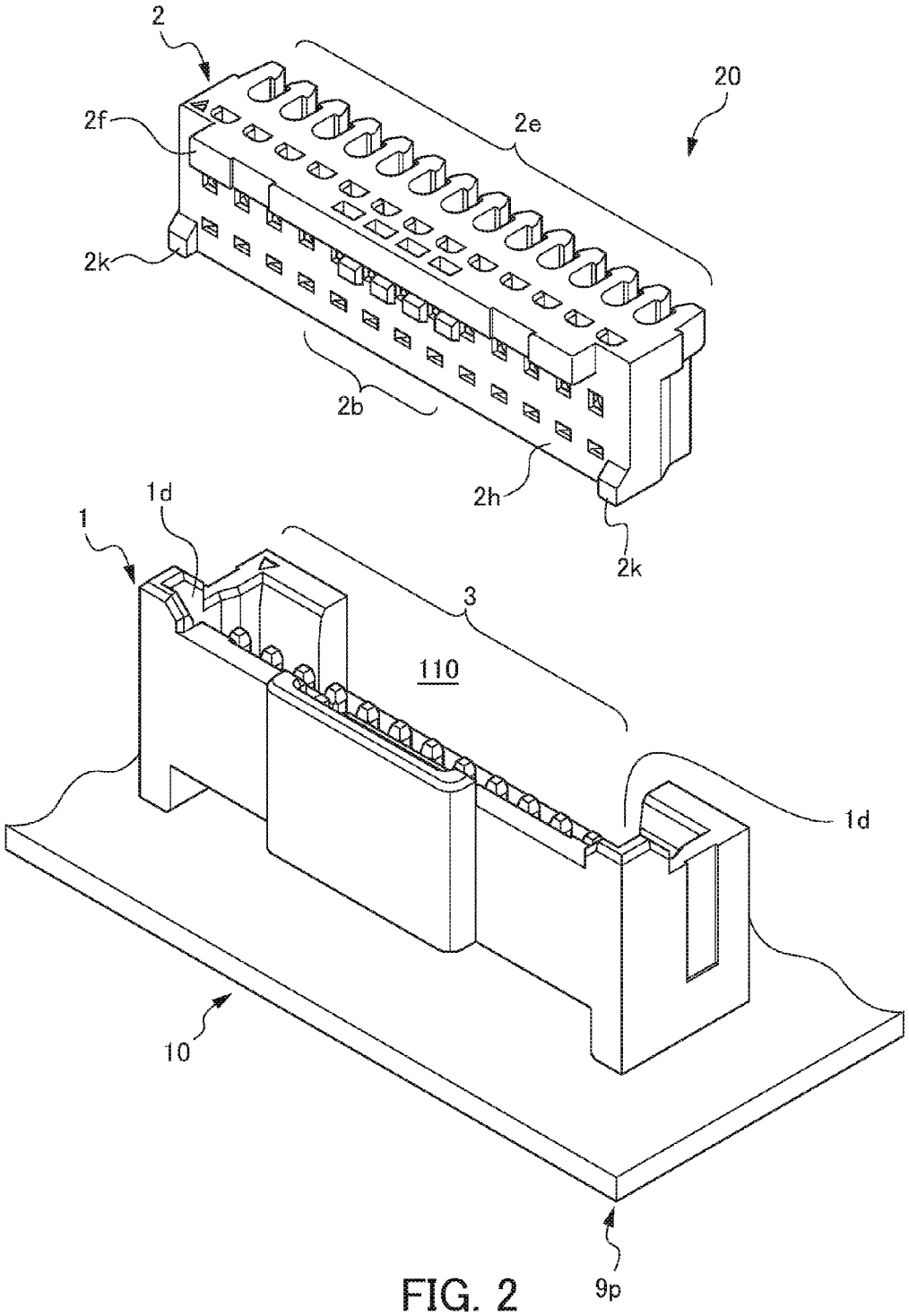
FIG. 2 is an oblique view showing the constitution of the connector with a locking mechanism according to this embodiment, and shows a state wherein the one first connector and the other second connector are disposed facing each other.

FIG. 1 is an oblique view showing the constitution of the connector with a locking mechanism according to one embodiment of the present invention, and shows a state wherein the one first connector and the other second connector are connected. FIG. 2 is an oblique view showing the constitution of the connector with a locking mechanism according to this embodiment, and shows a state wherein the one first connector and the other second connector are disposed facing each other.

Figure 3:
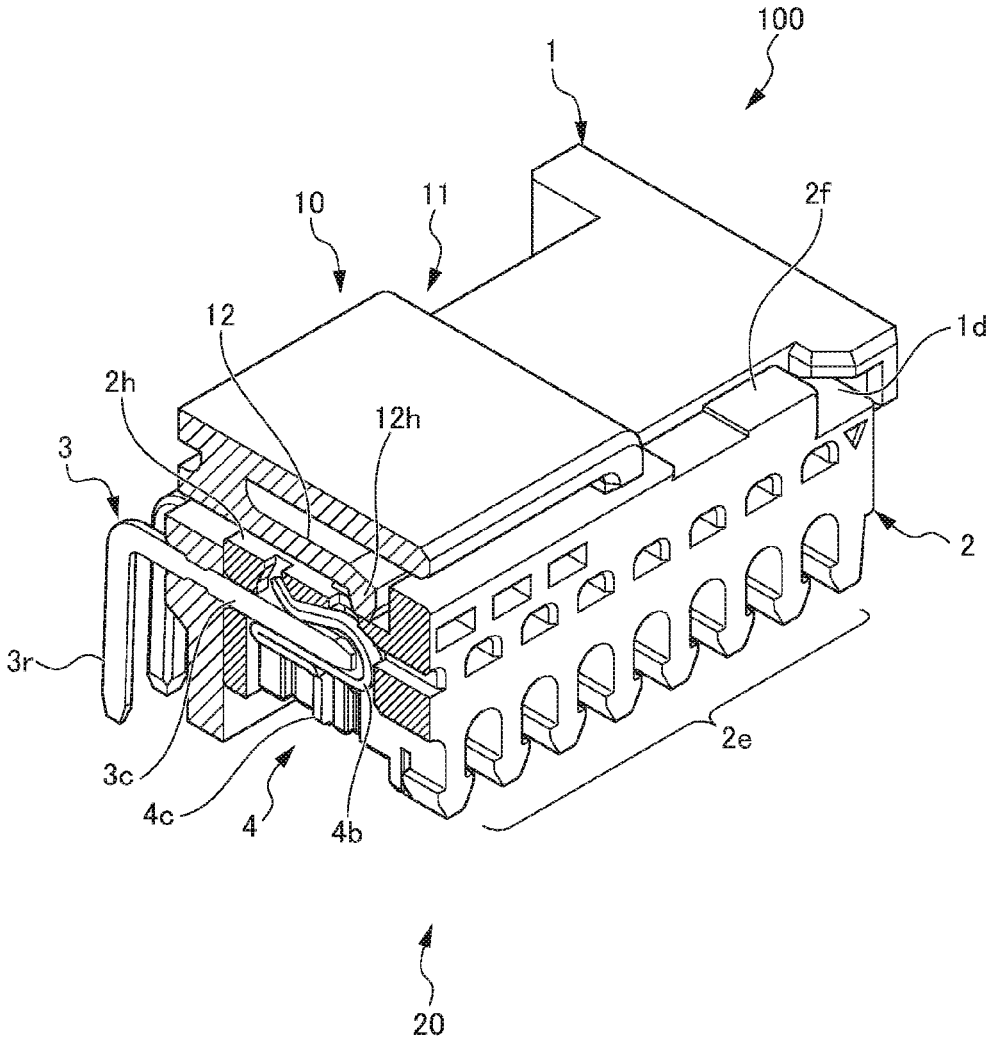
FIG. 3 is an oblique cross sectional view showing the constitution of the connector with a locking mechanism according to this embodiment, and shows a state wherein the one first connector and the other second connector are connected.

FIG. 3 is an oblique cross sectional view showing the constitution of the connector with a locking mechanism according to this embodiment, and shows a state wherein the one first connector and the other second connector are connected.

Figure 4C:
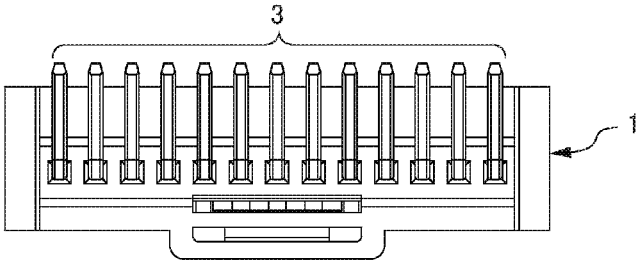
FIGS. 4A to 4F are drawings showing the constitution of the connector with a locking mechanism according to this embodiment.
Figure 4E:
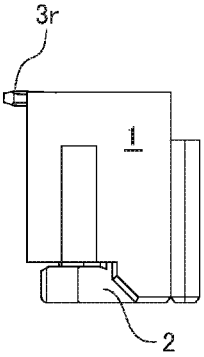
Figure 4A:
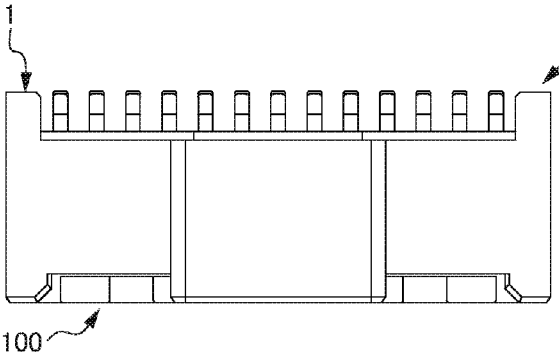
Figure 4D:
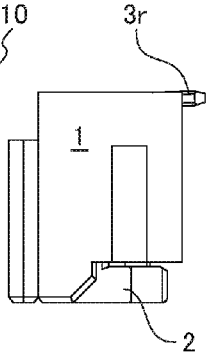
Figure 4B:
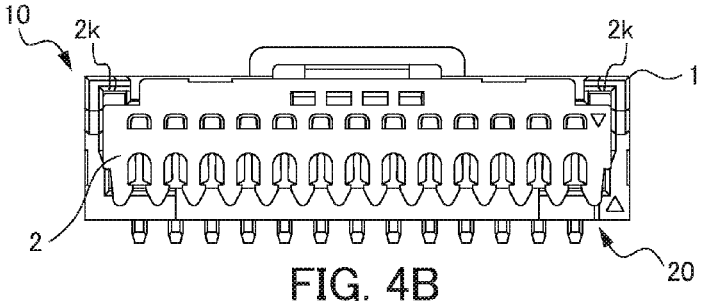
Figure 4F:
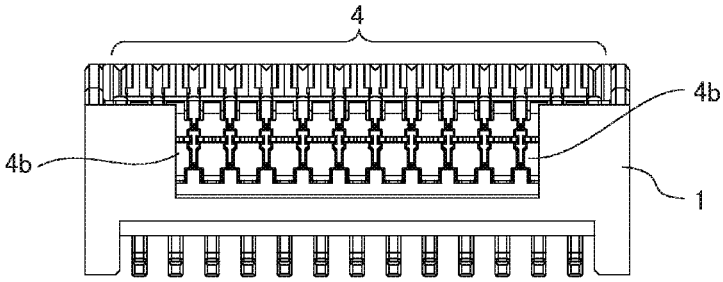

FIGS. 4A to 4F are drawings showing the constitution of the connector with a locking mechanism according to this embodiment, and FIG. 4A is a plan view of the connector with a locking mechanism and shows a state wherein the one first connector and the other second connector are connected; FIG. 4B is a front view of FIG. 4A; FIG. 4C is a back view of FIG. 4A; FIG. 4D is a right side view of FIG. 4A; 4E is a left side view of FIG. 4A; and FIG. 4F is a bottom view of FIG. 4A.

Figure 5:
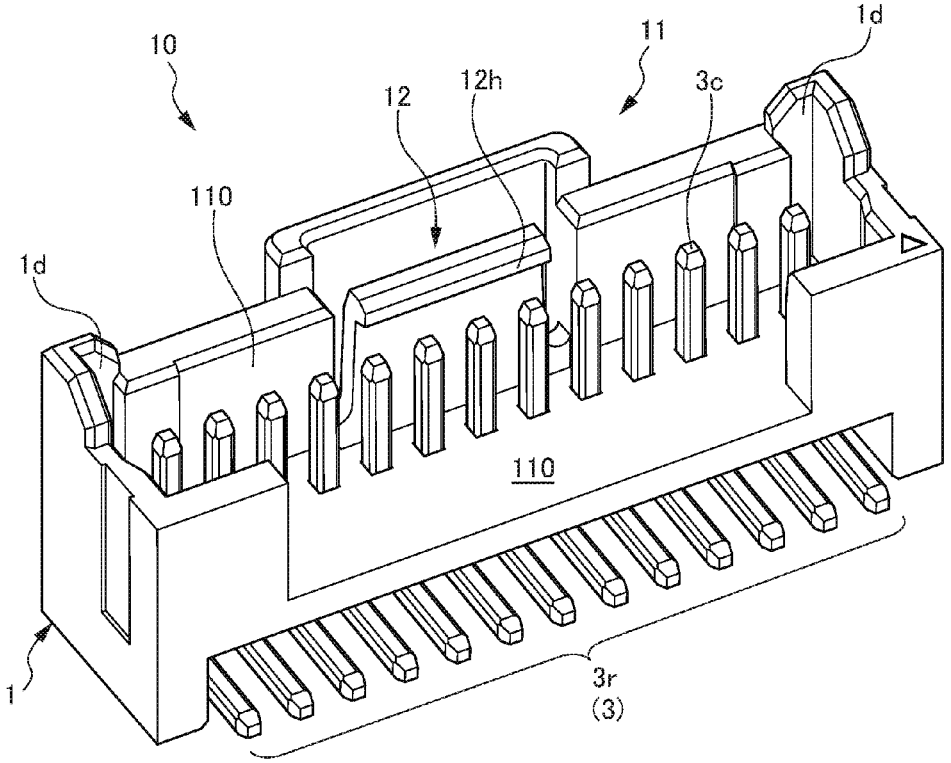
FIG. 5 is an oblique view showing the constitution of the one first connector according to this embodiment, as seen from the lower face side of the one first connector.

FIG. 5 is an oblique view showing the constitution of the one first connector according to this embodiment, as seen from the lower face side of the one first connector.

Figure 6:
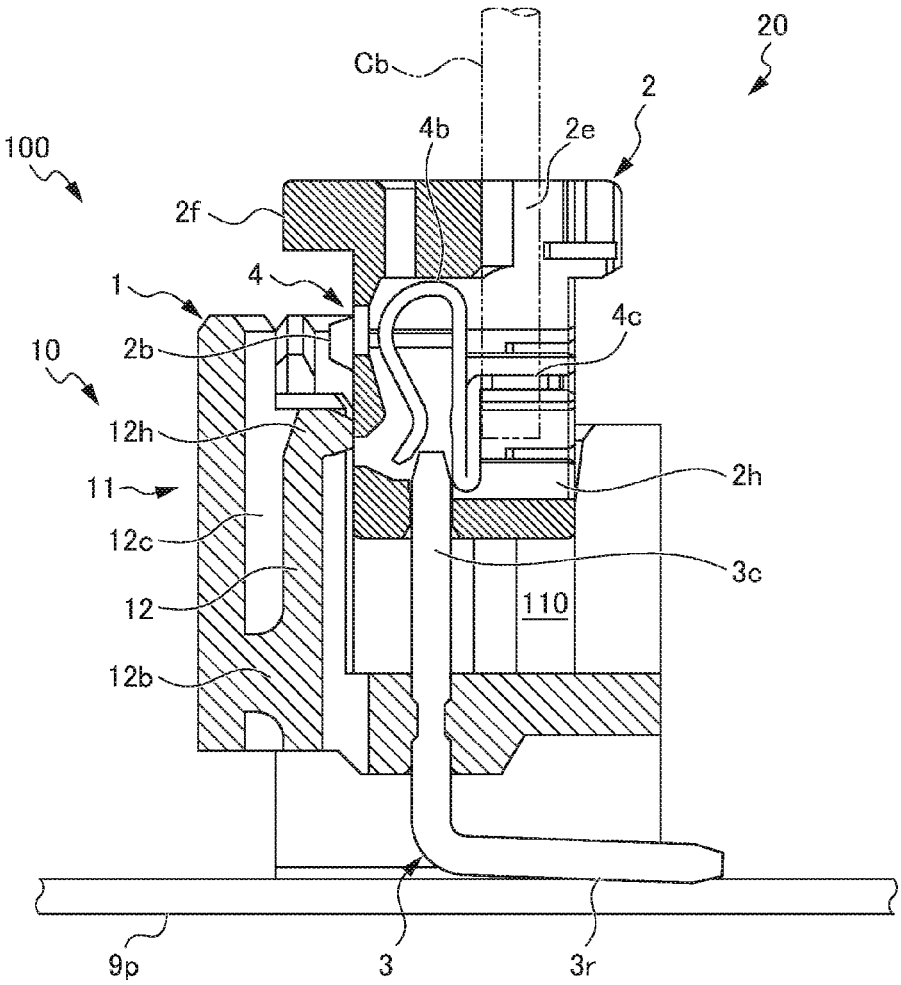
FIG. 6 is a longitudinal section view showing the constitution of the connector with a locking mechanism according to this embodiment, and shows a state before the other second connector is inserted into the one first connector.
Figure 7:
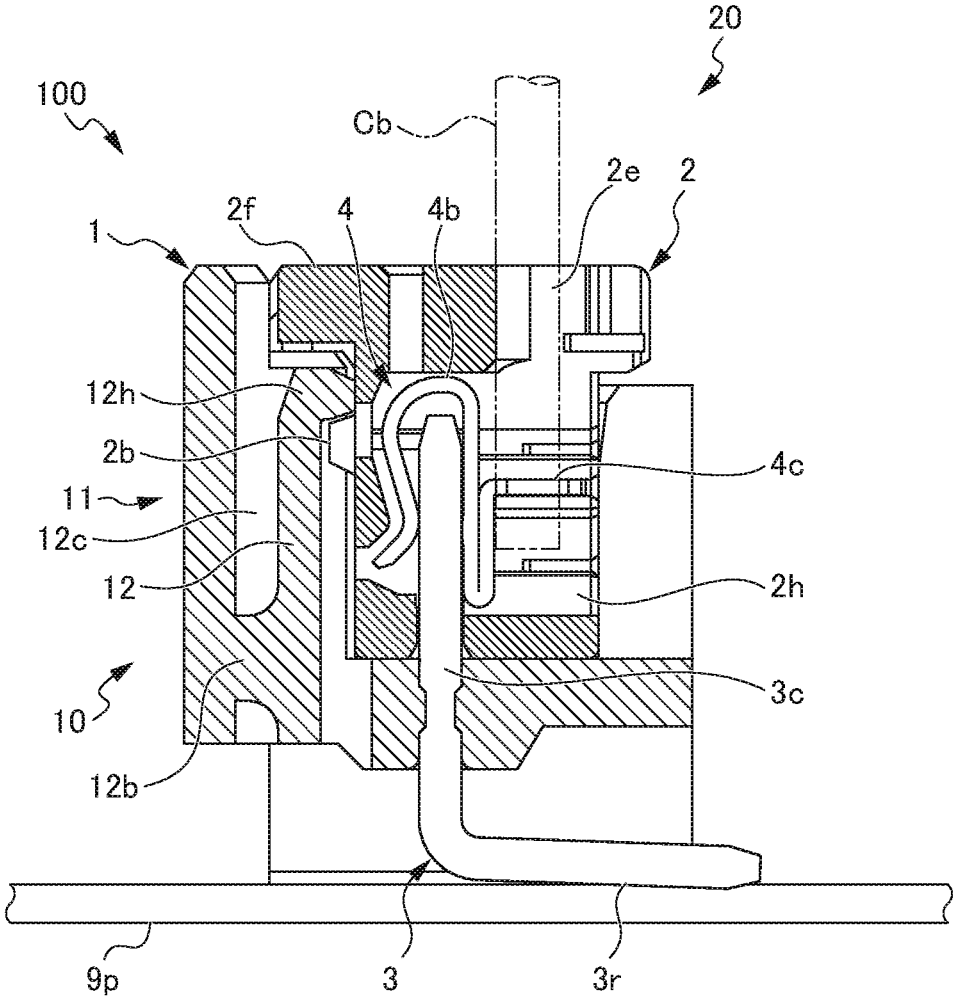
FIG. 7 is a longitudinal section view showing the constitution of the connector with a locking mechanism according to this embodiment, and shows a state wherein the other second connector has been inserted into the one first connector.

FIG. 6 is a longitudinal section view showing the constitution of the connector with a locking mechanism according to this embodiment, and shows a state before the other second connector is inserted into the one first connector. FIG. 7 is a longitudinal section view showing the constitution of the connector with a locking mechanism according to this embodiment, and shows a state wherein the other second connector has been inserted into the one first connector.

(Overall Constitution)

With reference to FIGS. 1 to 7, the connector with a locking mechanism (Hereinafter, abbreviated as "connector") 100 according to one embodiment of the present invention is provided with a locking mechanism 11 capable of engaging and disengaging the one first connector (Hereinafter referred to as "receptacle") 10, and the other second connector (Hereinafter referred to as "plug") 20 with each other.

With reference to FIGS. 1 to 7, the receptacle 10 is provided with a rectangular solid-shaped first housing 1, and with a plurality of first contacts 3.

The first housing 1 has a recess portion 110 where one face has an approximately rectangular-shaped opening (refer to FIG. 2 or FIGS. 5 and 6).

The first contact 3 has a pin-shaped connecting terminal 3*c* disposed at an inner portion of the recess portion 110 (refer to FIGS. 5 to 7).

With reference to FIGS. 1 to 4 and 6 or 7, the plug 20 is provided with a rectangular solid-shaped second housing 2, and a plurality of second contacts 4. The second housing 2 has a header portion 2*h* at one end side, and has a flange portion 2*f* at the other end (refer to FIG. 3 or FIG. 6 and FIG. 7). The header portion 2*h* can fit into the recess portion 110 of the first housing 1. The flange portion 2*f* partially abuts one face of the first housing 1.

With reference to FIG. 3 or FIG. 6 and FIG. 7, the second contact 4 is disposed at an inner portion of the second housing 2. The second contact 4 has a bellows terminal 4*b* at one end. The bellows terminal 4*b* can be electrically connected to the connecting terminal 3*c* of the first contact 3.

With reference to FIG. 3 or FIG. 5 and FIG. 6 or FIG. 7, the first housing 1 has a strip-shaped lock arm 12. The lock arm 12 is provided at a prescribed space 12*c* from one inner wall of the recess portion 110, and projects from a bottom portion of the recess portion 110 towards an open face of the recess portion 110, approximately parallel to one inner wall of the recess portion 110. Further, the lock arm 12, at the base end side thereof, may be provided with a connecting portion 12*b* with one inner wall of the recess portion 110.

Furthermore, with reference to FIG. 3 or FIG. 5 and FIG. 6 or FIG. 7, the lock arm 12 is provided at its tip with a trapezoidal-shaped hook portion 12*h*. The hook portion 12*h* projects towards a central portion of the recess portion 110. In other words, the shape of the longitudinal section of the portion of the hook portion 12*h* that projects towards the central portion of the recess portion 110 is a trapezoidal shape.

On the other hand, with reference to FIG. 2 or FIG. 6 and FIG. 7, the second housing 2 has four quadrangular frustrum-shaped engaging protrusions 2*b*. These engaging protrusions 2*b* protrude from one face of the header portion 2*h*. In other words, the shape of the longitudinal section of the engaging protrusions 2*b* is a trapezoidal shape. Thus, these engaging protrusions 2*b* can engage and disengage with the hook portion 12*h* of the lock arm 12 (refer to FIG. 6 and FIG. 7).

With reference to FIG. 6 and FIG. 7, in the connector 100 according to the embodiment, when the header portion 2*h* is inserted into the recess portion 110, the engaging protrusions 2*b* elastically deform the lock arm 12 and displace the hook portion 2*h*, and the engaging protrusions 2*b* ride over the hook portion 12*h*, and the complete fitting of the receptacle 10 and the plug 20 can be felt. On the other hand, when pulling out the header portion 2*h* from the recess portion 110, the hook portion 12*h* is displaced, and the plug 20 can be readily pulled out from the receptacle 10. Namely, the above described prescribed space 12*c* provided between one inner wall of the recess portion 110 and the lock arm 12 is provided in order to allow for the elastic deformation of the lock arm 12 when the engaging protrusions 2*b* of the second housing 2 ride over the hook portion 12*h*.

(Constitution of the First Housing)

Next, the constitution of the first housing 1 according to the embodiment is explained. With reference to FIG. 1 to FIG. 7, the first housing 1 has insulating properties. The first housing 1 is molded of a synthetic resin consisting of a non-conductive material, which allows obtaining the desired form.

With reference to FIG. 2 to FIG. 5, the first housing 1 has a pair of key grooves 1*d*, 1*d*. The pair of key grooves 1*d*, 1*d* communicates with the recess portion 110. Further, the pair of key grooves 1*d*, 1*d* is formed at one inner wall of the recess portion 110. Preferably, the key grooves 1*d*, 1*d* are respectively formed at both ends of one inner wall of the recess portion 110. The pair of key grooves 1*d*, 1*d* slidably guides the later described key 2*k*.

On the other hand, with reference to FIG. 2 or FIG. 4, the second housing 2, at the header portion 2*h*, has a pair of keys 2*k*, 2*k*. The pair of keys 2*k*, 2*k* protrudes from one face of the header portion 2*h*. Further, the pair of keys 2*k*, 2*k* is disposed at a front portion of one face of the header portion 2*h* so as to be able to pass through the above mentioned pair of key grooves 1*d*, 1*d*.

With reference to FIG. 2, the pair of keys 2*k*, 2*k* can fit with the pair of key grooves 1*d*, 1*d*. When the plug 20 is to be inserted into the recess portion 110 of the receptacle 10 with an incorrect orientation, the pair of keys 2*k*, 2*k* abut one face of the first housing 1, whereby erroneous insertion of the plug 20 can be prevented in advance.

(Constitution of the First Contact)

Next, the constitution of the first contact 3 according to the embodiment is explained. With reference to FIG. 2 to FIG. 7, the desired form of the first contact 3 can be obtained by processing by stamping a conductive metal plate. For the first contact 3, in consideration of the ease of processing, spring characteristics, conductivity and the like, for example, a copper alloy is preferably used, but it is not limited to copper alloys.

With reference to FIG. 3 or FIG. 5 to FIG. 7, the first contact 3 has a lead terminal 3*r*. The lead terminal 3*r* is continuous with the connecting terminal 3*c*. By solder joining the lead terminal 3*r* to a pattern (not shown in the drawings) on the surface of the printed circuit board 9*p*, the receptacle 10 can be mounted on the printed circuit board 9 (refer to FIG. 1 or FIG. 2).

Further, with reference to FIG. 3 or FIG. 5 to FIG. 7, in order to mount the first contact 3 onto the surface of the printed circuit board 9*p*, the lead terminal 3*r* is bent at an approximately right angle with respect to the connecting terminal 3*c*.

(Constitution of the Second Housing)

Next, the constitution of the second housing 2 of the embodiment is explained. With reference to FIG. 1 to FIG. 4 and FIG. 6 or FIG. 7, the second housing 2 has insulating properties. The second housing 2 is molded of a synthetic resin consisting of a non-conductive material, which allows obtaining the desired form.

With reference to FIG. 1 to FIG. 3, the second housing 2 has a plurality of receiving grooves 2*e* opened on its lower face. A cable Cb is installed in the receiving grooves 2*e* from an outer circumferential direction. The receiving grooves 2*e* contract at the opening side in a letter Q shape to make it difficult for the cable Cb to separate from the second housing 2.

With reference to FIG. 6 and FIG. 7, the later described pressure welding terminal 4*c* is disposed at an inner side of the receiving groove 2*e*. When the cable Cb is introduced into the receiving groove 2*e* from an outer circumferential direction thereof, a pair of pressure welding blades (not shown in the drawings) provided at the pressure welding terminal 4*c* push aside the insulation of the cable Cb, and the core wire of the cable Cb can be electrically connected with the pressure welding terminal 4*c*.

(Constitution of the Second Contact)

Next, the constitution of the second contact 4 according to the embodiment is explained. With reference to FIG. 3 or FIG. 6 and FIG. 7, the desired form of the second contact 4 can be obtained by processing by stamping a conductive metal plate. For the second contact 4, in consideration of the ease of processing, spring characteristics, conductivity and the like, for example, a copper alloy is preferably used, but it is not limited to copper alloys.

With reference to FIG. 3 or FIG. 5 to FIG. 7, the second contact 4 has a pressure welding terminal 4*c* at its other end portion. The pressure welding terminal 4*c* is hard-wired to the end of the cable Cb introduced into the receiving groove 2*e* by pressure welding. Thus, a plurality of cables Cb are provided extending from one face of the plug 20 (refer to FIG. 1).

[Operation of the Connector with a Locking Mechanism]

In the connector with a locking mechanism according to the present invention, the one first connector (receptacle) 10 is constituted such that a lock arm 12 projects towards an open face of the recess portion 110 of the first housing 1, and a hook portion 12*h* of the tip of the hook arm 12 projects towards the central portion of the recess portion 110; and at the other second connector (plug) 20, the header portion 2*h* thereof is provided with quadrangular frustum-shaped engaging protrusions 2*b* which are capable of engaging and disengaging with the hook portion 12*h*. When the header portion 2*h* is inserted into the recess portion 110, the engaging protrusions 2*b* elastically deform the lock arm 12 and displace the hook portion 2*h*, and the engaging protrusions 2*b* ride over the hook portion 2*h*, and the complete fitting of the first connector 10 and the second connector 20 can be felt, and when pulling out the header portion 2*h* from the recess portion 110, the hook portion 12*h* is displaced in the same way, the engaging protrusions 2*b* ride over the hook portion 2*h*, and the second connector can be readily pulled out from the first connector. Concerning this, while explaining the operation of the connector 100 according to the embodiment, the action and effects of the connector 100 will also be explained.

With reference to FIG. 1 and FIG. 2, by inserting the plug 20 into the recess portion 110 of the receptacle 10 from a perpendicular direction of the printed circuit board 9*p*, the cable Cb can be electrically connected with the pattern of the printed board 9*p* via the second contact 4 and the first contact 3 (refer to FIG. 7). The connector 100 according to this embodiment can be called a "circuit board to wire connector".

From the state shown in FIG. 6, when the plug 20 is inserted into the inner portion of the recess portion 110 of the receptacle 10, the engaging protrusions 2*b* abut the hook portion 12*h*. On further inserting the plug 20, the abutting face of the engaging protrusions 2*b* and the hook portion 12*h* forms an inclined plane, thus the hook portion 12*h* is displaced towards one inner wall of the recess portion 110 by the elastic deformation of the lock arm 12. On further inserting the plug 20, the engaging protrusions 2*b* ride over the hook portion 12*h* (refer to FIG. 7), the lock arm 12 and the hook portion 12*h* are elastically restored, and the complete fitting of the plug 20 and the receptacle 10 can be felt.

On the other hand, from the state shown in FIG. 7, when the plug 20 is pulled out from the recess portion 110 of the receptacle 10, the abutting face of the engaging protrusions 2*b* and the hook 12*h* forms an inclined plane, and therefore, the hook portion 12*h* is displaced towards one inner wall of the recess portion 110 by the elastic deformation of the hook arm 12. In this way, it is possible to easily pull out the plug 20 from the receptacle 10 (refer to FIG. 6).

In the connector 100 according to this embodiment, the lock arm 12 which is the locking mechanism 11 is disposed inside the recess portion 110, and therefore, there is no concern of other mounted devices mounted on the printed circuit board 9*p* abutting the lock arm the and locking of the connector becoming unstable.

Further, in the connector 100 according to the embodiment, in addition to being able to feel the complete fitting of the receptacle 10 and the plug 20, the receptacle 10 and the plug 20 are readily attached and detached, and the operability is excellent.

The embodiment according to the present invention discloses a rectangular-shaped connector with a locking mechanism for a circuit board to wiring connector, but the connector with a locking mechanism according to the present invention is not limited to a circuit board to wiring connector. Further, the connector with a locking mechanism according to the present invention may also be adapted to a round-shaped connector.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A connector with a locking mechanism provided with a locking mechanism capable of engaging and disengaging with each other one first connector and another second connector, wherein:

the first connector comprises a rectangular solid-shaped first housing having a recess portion where one face has an approximately rectangular-shaped opening, and one or more first contacts with a pin-shaped connecting terminal disposed at an inner portion of the recess portion, and the second connector comprises a rectangular solid-shaped second housing having at one end side a header portion which is fittable in the recess portion, and having at another end a flange portion which is partially abuttable with one face of the first housing, and a second contact disposed at an inner portion of the second housing and having at one end a bellows terminal which is connectable with the connecting terminal of the first contact, and wherein the first housing has a strip-shaped lock arm which is provided at a prescribed space from one inner wall of the recess portion and which projects from a bottom portion of the recess portion towards the open face of the recess portion and approximately parallel to the one inner wall of the recess portion, the lock arm being provided at its tip with a trapezoidal-shaped hook portion projecting towards a central portion of the recess portion, and the second housing has two or more quadrangular frustum-shaped engaging protrusions which are capable of engaging and disengaging with the hook portion, protruding from one face of the header portion, wherein the hook portion is located at a central portion of the first connector.

2. A connector with a locking mechanism according to claim 1, wherein the first contact has a lead terminal which is continuous with the connecting terminal, and which can be solder-joined to the printed circuit board.

3. A connector with a locking mechanism according to claim 2, wherein in the first contact, the lead terminal is bent at an approximately right angle with respect to the connecting terminal.

4. A connector with a locking mechanism according to claim 2, wherein the second contact has at another end a pressure welding terminal for hard-wiring by pressure welding an end of a cable.

5. A connector with a locking mechanism according to claim 1, wherein the second contact has at another end a pressure welding terminal for hard-wiring by pressure welding an end of a cable.

6. A connector with a locking mechanism provided with a locking mechanism capable of engaging and disengaging with each other one first connector and another second connector, wherein:

the first connector comprises a rectangular solid-shaped first housing having a recess portion where one face has an approximately rectangular-shaped opening, and one or more first contacts with a pin-shaped connecting terminal disposed at an inner portion of the recess portion, and the second connector comprises a rectangular solid-shaped second housing having at one end side a header portion which is fittable in the recess portion, and having at another end a flange portion which is partially abuttable with one face of the first housing, and a second contact disposed at an inner portion of the second housing and having at one end a bellows terminal which is connectable with the connecting terminal of the first contact, and wherein the first housing has a strip-shaped lock arm which is provided at a prescribed space from one inner wall of the recess portion and which projects from a bottom portion of the recess portion towards the open face of the recess portion and approximately parallel to the one inner wall of the recess portion, the lock arm being provided at its tip with a trapezoidal-shaped hook portion projecting towards a central portion of the recess portion, and the second housing has two or more quadrangular frustum-shaped engaging protrusions which are capable of engaging and disengaging with the hook portion, protruding from one face of the header portion.

* * * * *